United States Patent [19]

Carrell

[11] Patent Number: 4,648,676

[45] Date of Patent: Mar. 10, 1987

[54] TERMINAL

[75] Inventor: Ross M. Carrell, Cinnaminson, N.J.

[73] Assignee: RCA Corporation, Princeton, N.J.

[21] Appl. No.: 738,394

[22] Filed: May 28, 1985

[51] Int. Cl.[4] ..... H01R 4/24

[52] U.S. Cl. ..... 339/97 R

[58] Field of Search ..... 339/97 R, 97 P, 98, 339/99 R

[56] References Cited

U.S. PATENT DOCUMENTS

| | | | |
|---|---|---|---|
| 3,824,527 | 7/1974 | Evans | 339/97 R |
| 4,118,103 | 10/1978 | Leidy et al. | 339/98 |
| 4,221,445 | 9/1980 | Fleischhacker | 339/97 R |
| 4,344,664 | 8/1982 | Walkup | 339/99 R |
| 4,387,509 | 6/1983 | Dechelette | 29/850 |
| 4,536,049 | 8/1985 | Wilmes | 339/97 R |

OTHER PUBLICATIONS

Standard Products Catalog/3, Third Edition, Catalog 2005-8, issued Aug. 1983, by AMP, Inc., pp. 46, 89-93, 228, 231, 280-285, 397, 440 and 479.

"Introduction to AMP insulation Displacement Technique and Products," Handbook HB 5351, Rev. C., AMP, Inc., FIGS. 2-4.

"AMP MTA Mass Termination Assemblies Printed Circuit Board Connectors," Catalog 77-451, Revised Dec. 1983, AMP, Inc., pp. 10-13, 32, 36, 40.

"Availability, Operation, and Size Ranges for automatic Discrete Wire Harness Mass Termination I.D. Connector Systems," Reprint from Insulation/Circuits, Lake Publishing Corp., June 1979, pp. 1-5.

"AMP Pneumatic Insertion Tool," Instruction Sheet IS 6799, Released Jul. 13, 1983, AMP, Inc.

"Application of the 100 Series Quadramate Terminal," Application Specification No. 114-2051, Rev. E, AMP, Inc.

*Primary Examiner*—Joseph H. McGlynn

*Attorney, Agent, or Firm*—Joseph S. Tripoli; William Squire

[57] ABSTRACT

An insulation displacement terminal includes at least one pair of wire receiving tines oriented in a plane normal to its post which is attached to a printed circuit board. An insulated wire is attached to the terminal by a pair of jaws which squeeze together in pliar-like fashion avoiding stressing the printed circuit board during the insertion.

1 Claim, 7 Drawing Figures

TERMINAL

This invention relates to an electrical wire terminal, and more particularly, to a terminal for making electrical interconnection to an insulated wire conductor by displacing the insulation and deforming the wire as it is inserted onto the terminal.

Of interest are copending applications Ser. No. 779,100, filed Sept. 23, 1985, entitled "Insulation Displacement Terminal Wire Inserton Tool and Method," by Ross Michael Carrell and George John Whitley and Ser. No. 779,099, filed Sept. 23, 1985, entitled "Pneumatic Insulation Displacement Terminal Wire Insertion Tool," by Brian Gerard Keeler and George John Whitley. Both of the above copending applications are assigned to the assignee of the present invention.

Terminals for receiving insulated wires directly which do not require that the insulation first be removed and which automatically cut into the insulation and deform the wire to make a reliable electrical connection, are in wide use and are known as insulation displacement terminals (IDTs). Such a terminal includes at least one bifurcated element forming a pair of spaced tines. The spacing between the tines is smaller than the diameter of the conductor of the insulated wire to be connected to the terminal. The terminal is designed so that when an insulated conductor is pushed into the space between the tines, the insulation is cut by the tines so that each tine makes electrical connection to the conductor. The insertion of the wire scrapes away any contamination on the surface of the conductor and the tine, deforming the conductor and bringing the fresh metal surfaces of the conductor and the tine together in compression. One example of the use of such terminals is illustrated in U.S. Pat. No. 4,387,509. A particular terminal which might be useful in the abovementioned patent is disclosed in U.S. Pat. No. 4,118,103. Another IDT which would be useful in the embodiment of the aforementioned U.S. Pat. No. 4,387,509 is a terminal known as "Quadra-mate" manufactured by AMP, Inc. This terminal employs a first pair of tine structures each as generally described above, aligned with a second mirror image pair of tine structures to form four parallel sets of tines for making electrical connection to a single wire. In the "Quadra-mate" structure, the inner pair of tine structures make contact with the conductor; the outer pair of the tine structures grip the insulation only.

Although many IDTs do not mount on printed circuit boards, many of the aforementioned IDTs include terminals or post portions for securing the tines to a printed circuit board or other substrate. In those terminals that are attached to substrates (some are used in connector bodies) the tines extend normal to the plane of the substrate when attached to the substrate so that when a wire is inserted in the space defined by the tines for connection to the terminal, the wire at the connection is parallel to the substrate plane. The reason for this orientation is that the wires are easily pushed into the terminal in a direction normal to the substrate plane by manual or machine insertion with a tool from above the substrate.

A problem with IDTs as presently commercially employed and illustrated by way of example in the aforementioned patents, is that the insertion tool usually applies a force of relatively large magnitude, for example, about 20 lbs., to push the wire into the IDT slot. In a case where the substrate to which the IDT is secured is a thin member such as a printed circuit board and so forth, support is required for the substrate to withstand that insertion force. Additionally, when a large number of IDTs or components are employed on a substrate, the substrate tends to have a large number of apertures. These apertures tend to weaken the substrate so as to make support of the substrate during insertion of the wire into the IDTs extremely important. Without such support, the substrate may tend to fracture or otherwise undesirably deform, precluding proper insertion of a wire into the IDT.

While the above arrangement may be acceptable for insertion of wires into substrates which can be placed in fixtures and jigs designed to support the IDTs at the insertion point, the problem becomes more acute when the substrate is relatively unsupported at the IDTs such as might occur, for example, in circuit control terminals which may be part of an electronic assembly such as a television receiver and not readily adaptable for such fixtures and jigs.

A terminal according to the present invention for receiving and making electrical contact with the conductor of an insulated wire comprises an electrically conductive post adapted to be secured upright to a substrate substantially normal to the plane of the substrate. A bifurcated wire receiving means is electrically conductively secured to the post and is adapted to receive the insulated wire and make electrical conductive contact therewith by piercing the insulation as the wire is received. The wire receiving means is oriented relative to the post so that the wire, where received, is substantially parallel to the post and normal to the substrate. This permits the wire to be squeezed onto the terminal in pliar-like fashion avoiding a direct force on the substrate during insertion of the wire.

Figure 1:
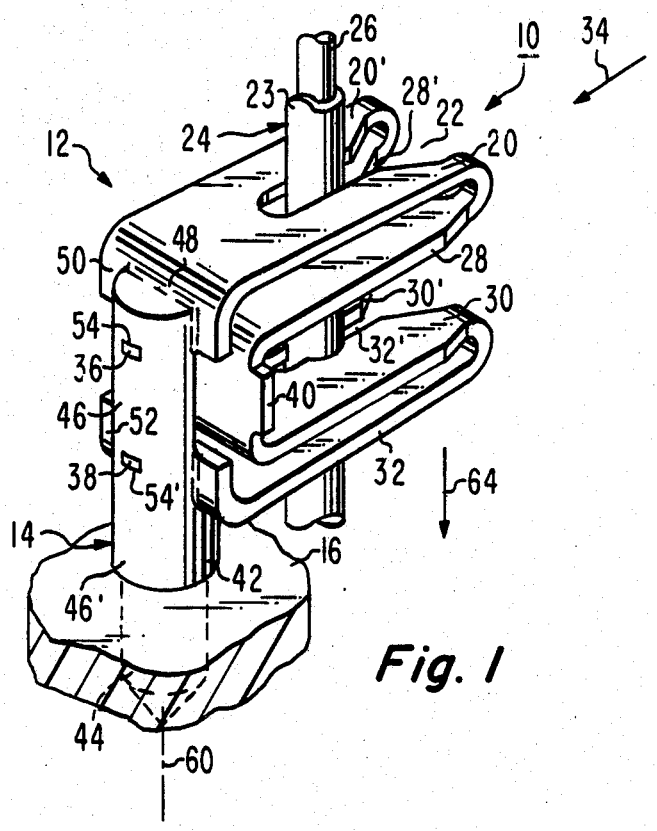
FIG. 1 is an isometric view of one embodiment of an IDT terminal according to the present invention attached to a planar substrate such as a printed circuit board.
Figure 2:
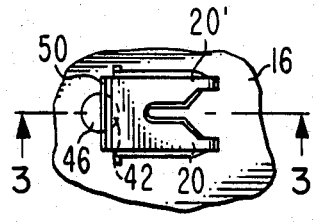
FIG. 2 is a plan view of the IDT terminal illustrated in FIG. 1.

In FIG. 1, terminal 10 includes an array 12 of insulation displacement tines and a post 14 to which the array 12 is attached. The array 12 is a commercially available IDT and, as illustrated, may comprise a portion of an IDT Quadra-mate terminal as manufactured by AMP, Inc. However, the array 12 differs from the Quadra-mate terminal in that the Quadra-mate terminal posts for attaching the terminal to a substrate are employed herein for attaching the array 12 to the post 14 and are foreshortened to fit onto the post 14. The Quadra-mate terminal posts may be foreshortened before or after attachment to post 14.

The array 12 includes four pairs of spaced parallel mating tines. Tines 20 and 20′ form a first pair spaced apart spacing 22 sufficient to compress and grip insulation 23 of wire 24 to isolate the contact points with the next adjacent pair of tines 28 and 28′ from external mechanical stress as may be caused by movement of the attached wire. The IDT array 12 further includes two sets of parallel tines 28 and 28′, 30 and 30′ which are spaced so as to deform the wire, scraping away any contamination on the tine and conductor surfaces, and creating a gas-tight compression bond between the conductor and the respective tine pairs. Tines 32 and 32′ are spaced apart in the manner of tines 20 and 20′ and perform an identical function. Reference is made to AMP, Inc. catalog 2005-8, issued August 1983, page 479, illustrating the IDT array 12 in more detail. Space 22 is sufficiently small with respect to the wire 24 so as to cut through the insulation, deform the wire, and make a compression bond contact with conductor 26 when the wire 24 is pushed into the space 22 in direction 34 parallel to post 14.

Tines 20 and 20′ extend from wall 50 from which extends leg 36 in direction 34. Tine set 32 and 32′ extends from wall 52 from which extends leg 38 also in direction 34. Tine sets 28, 28′ and 30, 30′ are interconnected by common wall 40 so that the array 12 may be fabricated from a single sheet of metal in the flat state and folded over into the configuration illustrated.

Post 14 includes a rib and support member 42 and a leg 44. The support member 42 comprises an upper section 46 and a lower section 46′. Upper section 46 is a semicircular cylinder having a planar surface 48 adapted to abut planar walls 50 and 52. Section 46 includes a pair of apertures 54 and 54′ which closely receive respective legs 36 and 38. Lower section 46′ is a circular cylinder which is closely spaced beneath wall 52. Depending from section 46′ is circular cylindrical leg 44 which is dimensioned to be inserted in a printed circuit board or other substrate aperture to which the IDT terminal 10 is to be attached. Leg 44 has a length sufficient to extend through the substrate 16 when the substrate is a printed circuit board. In this case, leg 44, which may be of reduced diameter as compared to section 46; may be soldered at 45, FIG. 3, to a printed circuit board conductor (not shown) on the board undersurface. The tine array 12 is secured to post 14 by soldering the legs 36 and 38 and walls 50 and 52 to post 14.

The longitudinal axis 60 of post 14 is normal to direction 34 and generally normal to the plane of the tines of array 12. In practice, the tines may be at a small angle relative to the normal to post 14, but this is acceptable. As a result, the wire 24, where attached to the tine array 12, however, is essentially parallel to axis 60 and normal to the plane of the substrate 16 to which post 14 is attached.

Figure 3:
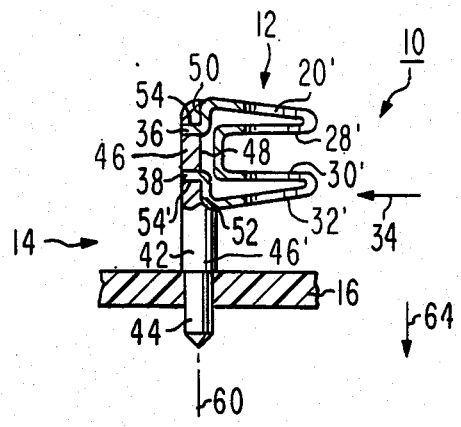
FIG. 3 is a side elevation view of the terminal of FIG. 2 taken along lines 3—3.

A particular advantage of the terminal 10 structure, as compared to prior art IDTs, is that the tines may be spaced above the substrate 16, FIG. 3, an amount sufficient to permit a pliar-like insertion tool to embrace the post to provide precise location and mechanical support during the insertion process. Even if the post were formed of sheet metal as described in connection with FIGS. 4 and 5 below, the support of the substrate at the post insertion region is sufficient to provide the necessary strength and rigidity during the insertion.

More importantly, the orientation of the tine array 12 in a horizontal plane, direction 34, normal to the axis 60 of the post avoids the problem mentioned in the introductory portion above in which the insertion tool tends to apply a force in direction 64 normal to the plane of the substrate 16. This avoids the tendency of such a normal force to bend, deform, or fracture the substrate unless the substrate 16 is supported in the region at post 14.

Figure 6:
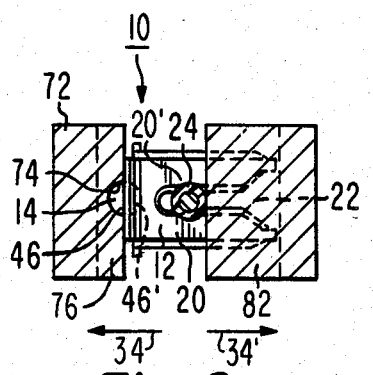
FIG. 6 is a plan view of the terminal of FIG. 2 illustrating the installation of an insulated wire onto the IDT in pliar-like fashion.
Figure 7:
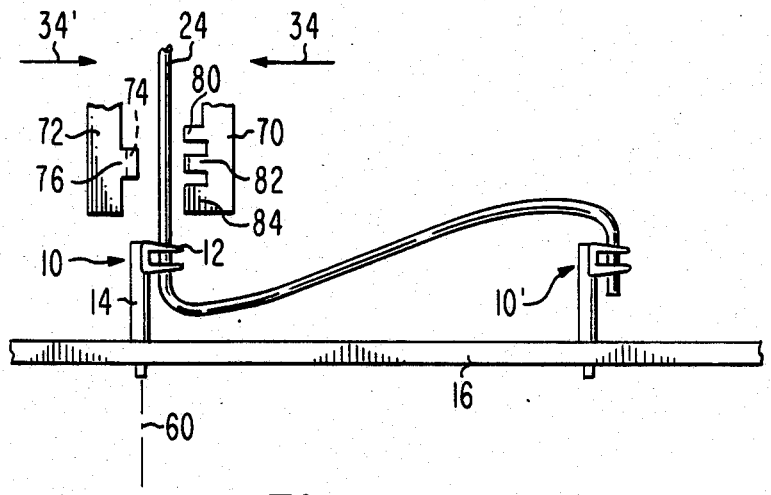
FIG. 7 is a side elevation view of a set of IDT terminals according to one embodiment of the present invention illustrating a method of point-to-point wiring on a substrate and a tool of the type shown in FIG. 6 for implementing the method.

In FIG. 6, a wire insertion tool for inserting wire 24 into the tines of array 12 may be pliar-like in construction and include a pair of jaws 70 and 72. The jaws 70 and 72 squeeze the wire 24 and terminal 10 together in pliar-like fashion to push the wire 24 into the spacing 22 of the tine array 12. Jaw 72 may include a groove 74 for closely receiving and abutting the post 14 and for locating the tine array 12 relative to jaws 70 and 72 in the horizontal plane parallel to substrate 16. In FIG. 7, the jaw 72 includes a projection 76 having a groove 74. Groove 74 closely receives and abuts the exterior surface of post 14 at sections 46 and 46′. Post 14 provides support for the squeezing forces exerted by jaws 70 and 72. Thus, jaw 72 bears the brunt of the reaction forces created by the insertion of wire 24 into array 12 in direction 34 and transmitted by post 14 to jaw 72.

Jaw 70 includes three teeth 80, 82, and 84 for pushing the wire 24 into the tines of terminal 10. Tooth 80 is constructed to push the wire 24 in a region above tines 20 and 20′, tooth 82 is constructed to push the wire 24 in a region between the tines of tine sets 28, 28′ and 30, 30′, FIG. 1, and tooth 84 is constructed to push against wire 24 immediately below the lowest set of tines 32, 32′.

Jaws 70 and 72 may be manually operated in pliar-like fashion for squeezing the wire 24 against terminal 10. By way of example, jaw 70 may be attached to a first arm (not shown) and jaw 72 to a second arm (not shown), with both arms pivoted for rotation about parallel axes. The ends of the arms opposite the jaws 70 and 72 may be then squeezed together or pushed apart according to a given implementation for operating the jaws 70 and 72 in the desired squeezing direction.

By providing jaws 70 and 72 which squeeze the wire 24 onto terminal 10, FIG. 7, in a plane parallel to the plane of substrate 16, relatively negligible wire insertion forces are applied to the substrate 16 and therefore alleviate the potential problem of deformation or stress failure of the substrate 16. Thus, wire 24 can be wired point-to-point on the substrate 16, FIG. 7, and is vertical where attached to the mating terminals.

Figure 4:
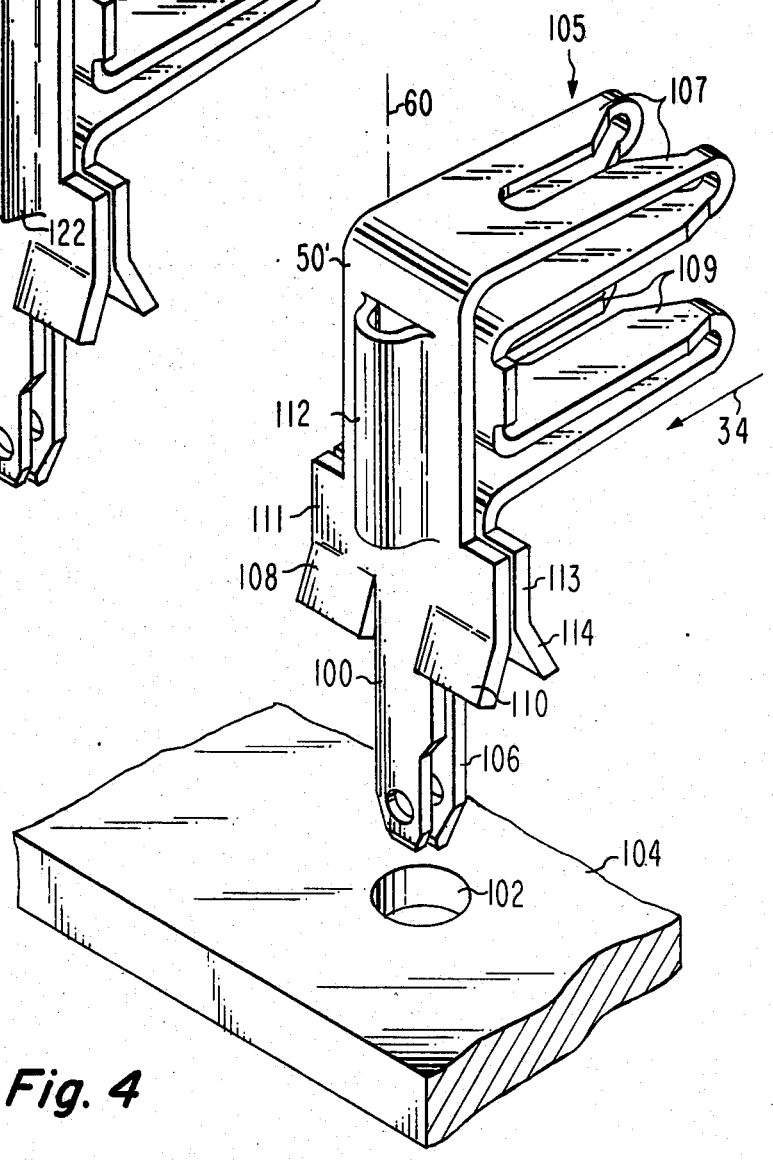

In FIG. 4, in the alternative, an IDT terminal 105, according to the present invention, is shown as fabricated from a single sheet of metal. In this case, a single wall 50′ corresponding to spaced walls 50 and 52 of terminal 10 FIG. 1, is attached to upper tines 107. Wall 50′ terminates via member 111 in post 100 dimensioned to be inserted in a hole 102 in substrate 104. The lowermost tine set 109 terminates via member 113 in a second post 106 facing and parallel to post 100 somewhat similar to the post arrangement employed in prior art structures, e.g., the Quadra-mate discussed above. Member 111 includes a pair of tangs 108 and 110 and member 113 includes a second pair of tangs 114 (one being shown) which are adapted to abut against the upper surface of substrate 104 when the posts 100 and 106 are inserted in substrate hole 102. A semicircular cylindrical rib 112 is formed in wall 50′ to reinforce wall 50′ for receiving and locating jaw 72, FIGS. 6 and 7.

Figure 5:
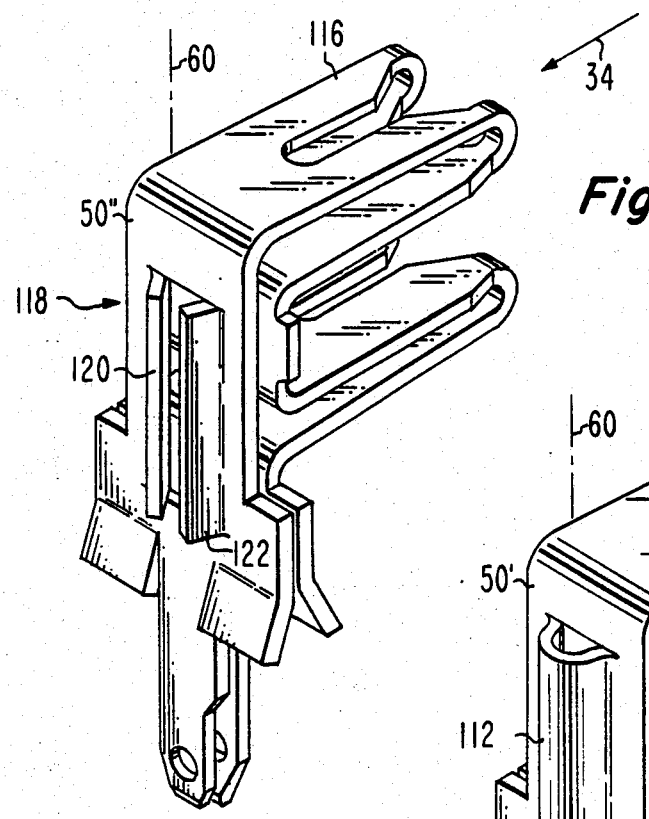
FIGS. 4 and 5 are isometric views of respective second and third embodiments of an IDT terminal according to the present invention.

In FIG. 5, terminal 116 in accordance with a third embodiment of the present invention may include a rib structure 118 formed from wall 50″ and comprising a pair of tangs 120 and 122. The remainder of the terminal 116 is similar in construction to terminal 105, FIG. 4. Terminal 116, therefore, is also fabricated from a single sheet of metal.

Terminals 105 of FIG. 4 and 116 of FIG. 5, each include respective ribs 112 and 118 which have a given length in the direction parallel to the post axis 60. These ribs can mate with a corresponding groove (not shown) having the same length in the corresponding insertion tool jaw such as jaw 72, FIGS. 6 and 7. In this case, seating of the rib 112 of terminal 109 or the rib 118 of terminal 116 in the groove of such a jaw would locate the terminal in the vertical direction parallel to axis 60 and the horizontal direction transverse to axis 60 normal to direction 34. While four sets of bifurcated wire receiving tines are shown, a terminal, according to the present invention, can employ at least one pair of wire receiving tines.

What is claimed is:

1. A printed circuit board terminal for receiving an insulated electrical conductor comprising:

a post having a tip portion adapted to be passed through a printed circuit board aperture and a shoulder portion adapted to abut a surface of the printed circuit board;

first and second pairs of parallel tines secured at one end thereof to and cantilevered from said post normal to the post, each pair of tines including spaced straight parallel edges for grasping the insulation of said electrical conductor;

a third and fourth pair of parallel tines, each pair including spaced straight parallel edges for cutting through said insulation and electrically contacting said conductor, said third and fourth pair being coupled to each other at one end, the other ends of the first and third pair being coupled to each other and the other ends of the second and fourth pair being coupled to each other; and a rib secured to the post adjacent the one end of and extending normal to the first and second pair of tines.

* * * * *